US006929484B2

(12) United States Patent
Weiss et al.

(10) Patent No.: US 6,929,484 B2
(45) Date of Patent: Aug. 16, 2005

(54) APPARATUS FOR APPLYING A MECHANICALLY-RELEASABLE BALANCED COMPRESSIVE LOAD TO AN ASSEMBLY SUCH AS A COMPLIANT ANISOTROPIC CONDUCTIVE ELASTOMER ELECTRICAL CONNECTOR

(76) Inventors: Roger E. Weiss, 10 Mary Way, Foxboro, MA (US) 02035; Glenn M. Amber, 1015 Summer St., Bridgewater, MA (US) 02324

( * ) Notice: Subject to any disclaimer, the term of this patent is extended or adjusted under 35 U.S.C. 154(b) by 0 days.

(21) Appl. No.: 10/863,377

(22) Filed: Jun. 8, 2004

(65) Prior Publication Data

US 2004/0219807 A1 Nov. 4, 2004

Related U.S. Application Data

(63) Continuation-in-part of application No. 10/339,180, filed on Jan. 9, 2003, now Pat. No. 6,835,072.

(51) Int. Cl.[7] ..... H01R 12/00
(52) U.S. Cl. ..... 439/66
(58) Field of Search ..... 439/66, 65, 67, 439/71, 72, 73, 91

(56) References Cited

U.S. PATENT DOCUMENTS 5,221,209 A * 6/1993 D'Amico ..... 439/71
5,653,600 A * 8/1997 Ollivier ..... 439/73
5,730,620 A * 3/1998 Chan et al. ..... 439/526
5,738,531 A * 4/1998 Beaman et al. ..... 439/71
5,793,618 A * 8/1998 Chan et al. ..... 361/809
5,810,607 A * 9/1998 Shih et al. ..... 439/66
5,919,050 A * 7/1999 Kehley et al. ..... 439/71
5,967,798 A * 10/1999 Tustaniwskyj et al. ..... 439/66
6,022,225 A * 2/2000 Chapin et al. ..... 439/73
6,042,388 A * 3/2000 Tustaniwskyj et al. ..... 439/66
6,042,412 A * 3/2000 Murr ..... 439/331
6,074,219 A * 6/2000 Tustaniwskyj et al. ..... 439/66
6,168,442 B1 * 1/2001 Naoi ..... 439/91
6,181,567 B1 * 1/2001 Roemer et al. ..... 361/760
6,286,208 B1 * 9/2001 Shih et al. ..... 29/879
6,325,638 B1 * 12/2001 Chapin et al. ..... 439/73
6,354,844 B1 * 3/2002 Coico et al. ..... 439/66
6,375,475 B1 * 4/2002 Brodsky ..... 439/66
6,386,890 B1 * 5/2002 Bhatt et al. ..... 439/67
6,449,162 B1 * 9/2002 Corbin et al. ..... 361/719
6,475,011 B1 * 11/2002 Sinha et al. ..... 439/330
6,477,058 B1 * 11/2002 Luebs et al. ..... 361/784
6,490,161 B1 * 12/2002 Johnson ..... 361/704
6,658,729 B2 * 12/2003 Brodsky ..... 29/832
6,743,026 B1 * 6/2004 Brodsky ..... 439/73
6,792,375 B2 * 9/2004 Colbert et al. ..... 702/117

* cited by examiner

*Primary Examiner*—Ross Gushi

(57) ABSTRACT

An apparatus for applying a mechanically-releasable balanced compressive load to an assembly such as a compliant electrical connector that electrically connects an electrical device to a first side of a two-sided substrate. The apparatus includes a backup plate coupled to the second side of the substrate, a rocker plate behind the backup plate, the rocker plate touching the backup plate at only one location, and a rigid member coupled to the first side of the substrate. There are three or more pins mechanically coupled to the rocker plate and the rigid member. When there are four or more pins, a rocker member is mechanically coupled to two of the pins, and in contact with the rocker plate at a single pivot. A compressible spring, mechanically coupled to a pin, applies a force, coupled through the pin, to urge the backup plate and rigid member together and thereby compress the compliant electrical connector between the electrical device and the substrate to make the separable electrical connection.

31 Claims, 14 Drawing Sheets

FIGURE 2C
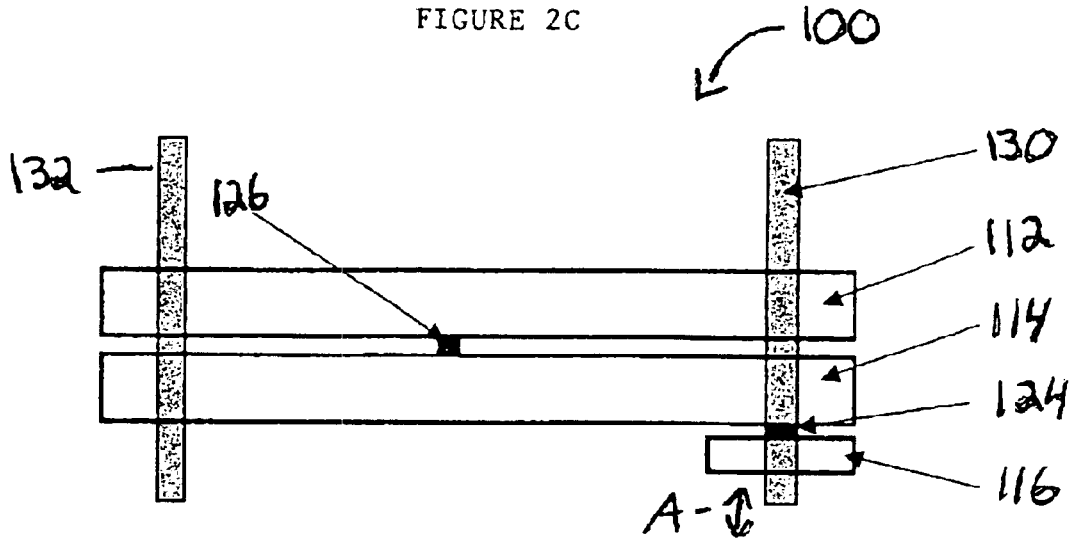
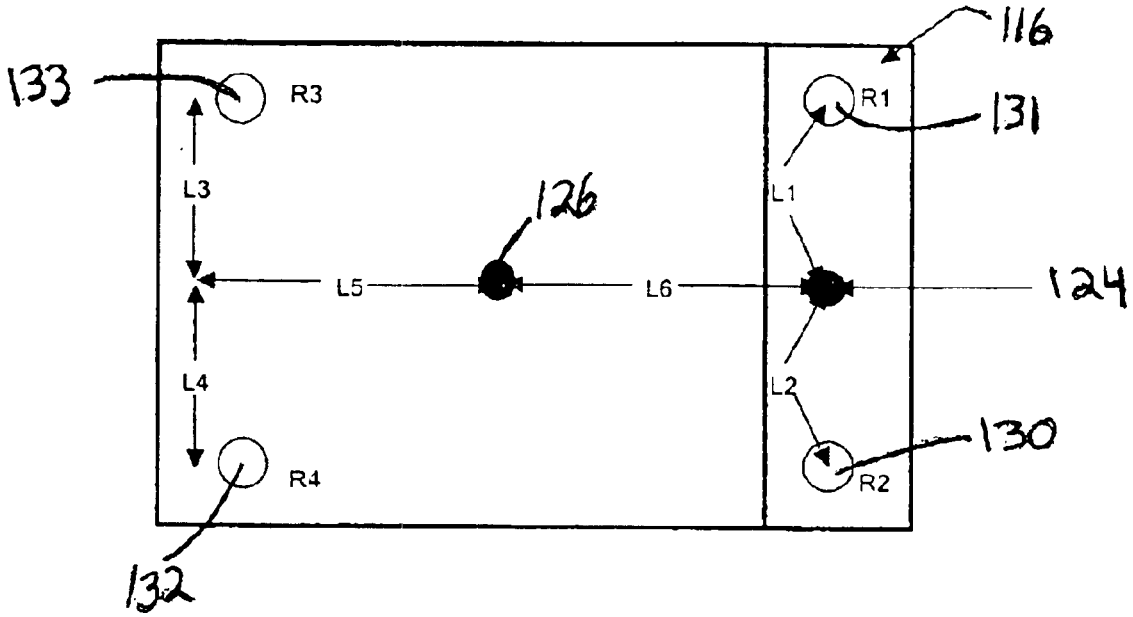
FIGURE 2D

APPARATUS FOR APPLYING A MECHANICALLY-RELEASABLE BALANCED COMPRESSIVE LOAD TO AN ASSEMBLY SUCH AS A COMPLIANT ANISOTROPIC CONDUCTIVE ELASTOMER ELECTRICAL CONNECTOR

CROSS REFERENCE TO RELATED APPLICATION

This application is a continuation in part of application Ser. No. 10/339,180, filed on Jan. 9, 2003 now U.S. Pat. No. 6,835,072.

FIELD OF THE INVENTION

This invention relates to an apparatus for applying a balanced compressive load to an assembly.

BACKGROUND OF THE INVENTION

There are many situations in which it is desirable or necessary to apply a mechanical, releasable balanced compressive load to an assembly. For example, in certain types of separable electrical connectors, a compliant interposer connector (a sheet of anisotropic conductive elastomer (ACE) material) is compressed between an electrical device and a corresponding array of electrically conductive pads on a substrate (e.g. a printed circuit board). The interposer conducts electricity vertically between each pad on the device and the corresponding pad on the substrate, while electrically isolating the pads from their laterally-adjacent neighbors. This has been done using a spring preload to compress the ACE between the device and the substrate.

One method of spring preloading such a system has been to have a flat, rigid backup plate below the substrate with four pins or bolts going up through four corresponding holes in the substrate. The interposer connector sits on pads on the top surface of the substrate; the device sits on the interposer connector; and a rigid plate, typically a heat sink, sits on the device. The four pins passing through the substrate typically go through clearance holes in the interposer connector, and extend upwards past the device through holes or slots in the heat sink. Above the heat sink, lock washers and nuts are placed on the ends of the pins. Tightening these nuts pulls the heat sink down, compressing the substrate/interposer connector/device stack-up between the backup plate and the heat sink. The advantage of this system is that the device can be replaced without accessing any hardware below the substrate. The disadvantage of this system is that the forces on the four pins must be carefully balanced to compress the system evenly.

Another disadvantage of this system is that the compressive spring element is the interposer itself, but the interposer in general has poor spring characteristics. In one modification of the above-described system, coil springs are placed over each of the four posts, between the heat sink and the washer/nut assembly. The springs can be designed to assure a quality compressive load. The problem of carefully tightening the springs to assure a balanced load remains a disadvantage of this design.

Another method of spring preloading the system has been to have four pins or bolts dropping down from the heat sink, through clearance holes in the interposer connector, the substrate, and a flat rigid backup plate. Holes or slots in a spring plate located below the rigid backup plate engage the four pins. The center of the spring plate has a threaded insert. The system is compressed using a set screw passing through the spring plate and engaged in the threaded insert by forcing the set screw against the backup plate, thus flexing the spring plate and compressing the substrate/interposer connector/device stack-up between the backup plate and the heat sink. The advantage of this system is that the forces on the stack-up are intrinsically centered since the only load applied to the backup plate is applied at its center. The disadvantage of this system is that the device cannot be replaced without accessing both the device side of the substrate and the set screw in the spring plate on the opposite side of the substrate. In many instances, access to the bottom of the board is not available.

Orthogonal interconnection electrical connectors, such as used with circuit pack to backplane interconnection, have several unique characteristics that must be addressed when developing a high performance connector system. For one, the connector must be capable of being physically actuated (connected and/or released) from the opposite end of the circuit pack (daughter board) from the connector. This separation can be as much as 24". Another limitation is that the mating of the circuit pack to the backplane is a blind mate that requires an alignment system specific to the structure. Also, backplanes are often bowed out of plane by the assembly process and the force of inserting the circuit pack. The forces causing the bowing must be counteracted. Still further, uniform loading and controlled positioning of the circuit pack relative to the backplane is required to achieve high performance.

In some such orthogonal connectors, sequencing of the order of make/break of individual contacts such as power and ground may be required. The ability to mix different types of contacts, such as power and fiber optic contacts, may also be required.

The above-described issues become more complex for high performance connectors, in which tight tolerance control is required to achieve the performance.

SUMMARY OF THE INVENTION

It is therefore an object of this invention to provide an apparatus for applying a mechanically-releasable balanced compressive load to an assembly. In the preferred embodiment, the assembly is an electrical connector containing compliant anisotropic conductive elastomer (ACE). The invention also relates to an electrical connector using such an apparatus.

It is a further object of this invention to provide such an apparatus that can be operated in situations in which there is access to only one side of the assembly.

The invention features in the preferred embodiment an electrical connector design which can be utilized with ACE materials to form orthogonal interconnection, such as used with circuit pack to backplane systems, with advanced electrical performance. The preferred embodiment of the invention thus provides a low-cost, high-performance electrical connector solution.

Anisotropic Conductive Elastomer (ACE) is a composite of conductive metal elements in an elastomeric matrix that is normally constructed such that it conducts along one axis only. In general, ACE is made to conduct through its thickness. One form of ACE material is made by mixing magnetic particles with a liquid resin, forming the mix into a continuous sheet, and curing the sheet in the presence of a magnetic field. This results in the particles forming a large number of closely spaced columns through the sheet thickness. The columns are electrically conductive. The resulting structure has the unique property of being both flexible and anisotropically conductive.

This invention features an apparatus for applying a mechanically-releasable balanced compressive load to an assembly, for example a compliant electrical connector that electrically connects an electrical device to a first side of a two-sided substrate. The apparatus includes a backup plate coupled to the second side of the assembly (e.g., the substrate of the assembly), a rocker plate behind the backup plate, the rocker plate touching the backup plate at only one location, a rigid member coupled to the first side of the substrate, and three or more pins mechanically coupled to the rocker plate and the rigid member. When four or more pins are used, one or more rocker members are coupled to the pins (one rocker member is coupled to two pins). Each rocker member contacts the rocker plate at only a single location. Means are mechanically coupled to at least one pin, for applying a force, coupled through the at least one pin, to urge the backup plate and rigid member together and thereby compress the assembly.

The apparatus may further comprise means for selectively applying the force, which may be accomplished with at least one spring member. The amount of force may be controlled by mechanically varying the spring compression. The apparatus preferably comprises four pins that are spaced equally from the center of the backup plate, and may include means for releasably engaging each pin with the rigid member. Such may be accomplished with a slot in the rigid member for accepting each pin, the slots having a keyhole shape, with a wider portion and a more narrow portion, to engage and disengage a pin. The pins may include an end that is smaller than the wider portion of the slot and larger than the more narrow portion of the slot, so that the pin can be releasably retained in the slot.

The rigid member may comprise a fixed portion and a movable portion to engage and disengage the pins, to allow the rigid member to be removed from the device. The movable portion may comprise a plate movable relative to the fixed portion. The apparatus may further include a spring between the movable plate and the fixed portion to urge the movable portion to a position in which it is disengaged from the pins.

The rocker arm pivot point is preferably equally spaced from the two pins to which the rocker arm is coupled. The means for applying a force may comprise a spring member coupled to a pin and to the rocker plate. The spring member may be selectively coupled to a pin and to the rigid member.

The spring member may comprise a coil spring on a pin. A member adjustable in length relative to the rocker plate may accomplish the touch of the rocker plate to the backup plate. The member adjustable in length may comprise a set screw threaded in the rocker plate, so that the length of the set screw between the rocker plate and the backup plate can be varied. The electrical connector may comprise compressible anisotropic conductive elastomer (ACE). At least one pin may be operable from the front side of the substrate. The pin operable from the front side of the substrate may be coupled to the electrical device. The pin may define a threaded end that is selectively receivable in the rocker plate. The pin may carry a spring member that is compressible to apply the force.

The apparatus may further comprise a flexible circuit in the electrical path between the device and the substrate. The compliant electrical connector may comprise ACE material between the flexible circuit and the substrate.

Also featured in the invention is an apparatus for applying a mechanically-releasable balanced compressive load to a compliant anisotropic conductive elastomer (ACE) electrical connector that electrically connects a circuit pack orthogonally to a first side of a two-sided substrate, comprising a backup plate coupled to the second side of the substrate, a rocker plate behind the backup plate, the rocker plate touching the backup plate at only one location, a rigid member coupled to the front side of the substrate, a layer of ACE between the circuit pack and the substrate, at least four pins mechanically coupled to the rocker plate and the rigid member, at least one spring member mechanically coupled to at least one pin, for applying a variable force coupled through the at least one pin, to urge the backup plate and rigid member together and thereby compress the ACE between the electrical device and the substrate, and means for releasably engaging each pin with the rigid member. One pin may be operable from the first side of the substrate and defines a threaded end selectively receivable in the rocker plate for selectively applying the spring force to compress the layer of ACE.

In addition to its use as part of a separable electrical connector assembly, the invention can be used in a number of additional applications in which a uniform clamping load is needed. Some of the examples envisioned include:

1. Quick release clamping of photo plates. In this example a thick glass plate with holes in the four corners would be clamped so as to uniformly load a film to the exposed element (film or photo resist on a printed circuit board etc.)

2. Clamping of biological samples. A microscope stage could incorporate the inventive clamping system to hold samples in the optical plane.

3. Quick release gluing fixture. When gluing sheet materials, the invention can accomplish a quick release clamp that provides a uniform load between sheets being glued.

4. Uniform loading gasket system. When mounting gaskets it is critically important to uniformly tighten the load around the gasket to have a good seal. This is a common problem in automobile head gaskets, vacuum systems etc. The invention could be employed to generate a uniform load on the entire structure while tightening a single bolt.

5. Tool machining fixture. The clamping of thin materials for machining operations is always a challenge. The invention could provide a quick release uniform loading clamp.

BRIEF DESCRIPTION OF THE DRAWINGS

Other objects, features and advantages will occur to those skilled in the art from the following description of the preferred embodiments and the accompanying drawings, in which:

FIGS. 2C and 2D are schematic side and bottom views, respectively, of the apparatus of FIGS. 2A and 2B;

DESCRIPTION OF THE PREFERRED EMBODIMENTS OF THE INVENTION

The preferred embodiment of the invention described in this application is a connector apparatus that automatically applies a balanced preload to an electrical connector with some compliance, which allows the electrical device that is connected with the connector to be replaced without necessarily requiring access to the underside of the substrate on which the electrical device is mounted.

Figure 1A:
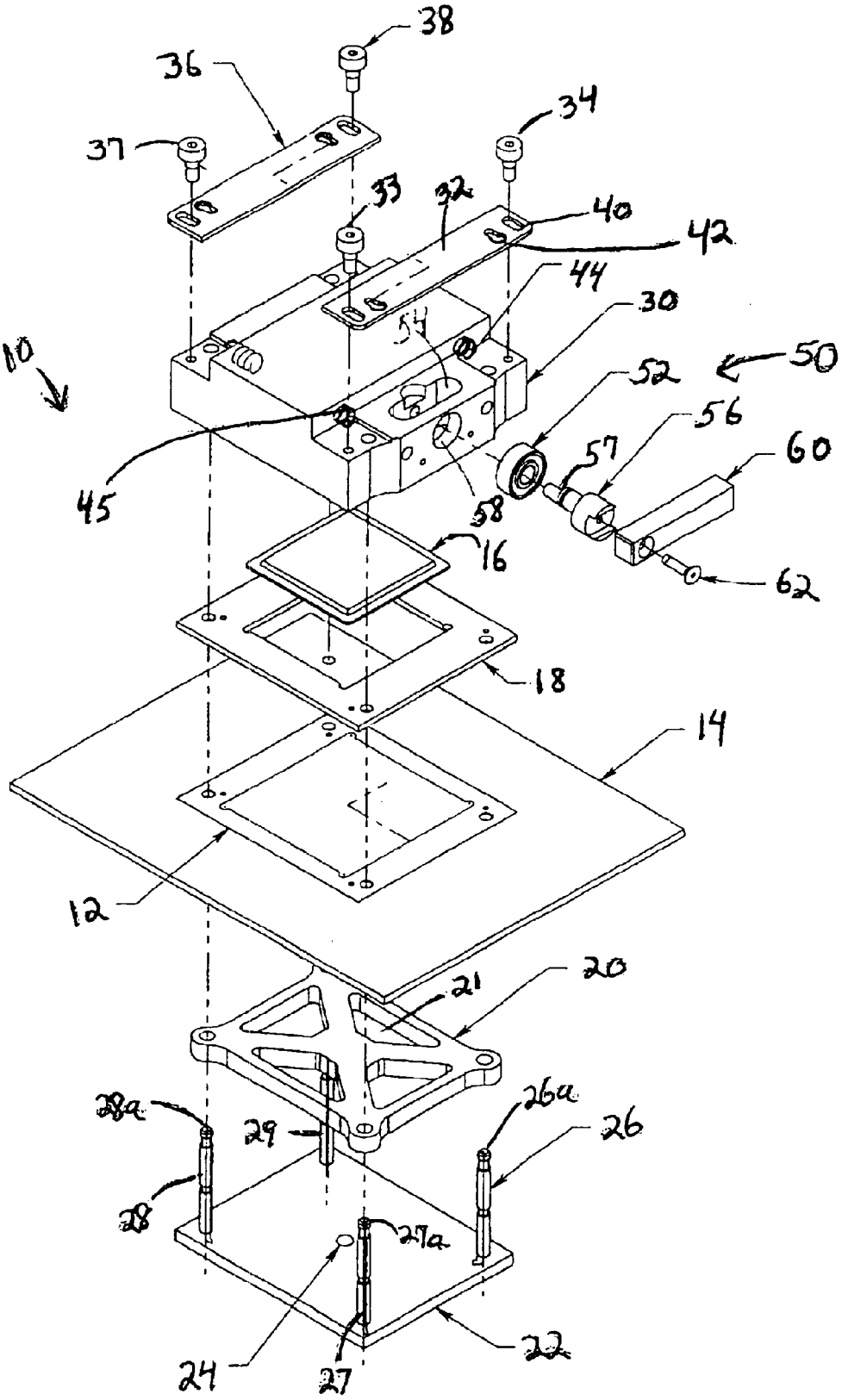
FIG. 1A is an exploded view and FIG. 1B an isometric view of one embodiment of a separable electrical connector system of this invention.
Figure 1B:
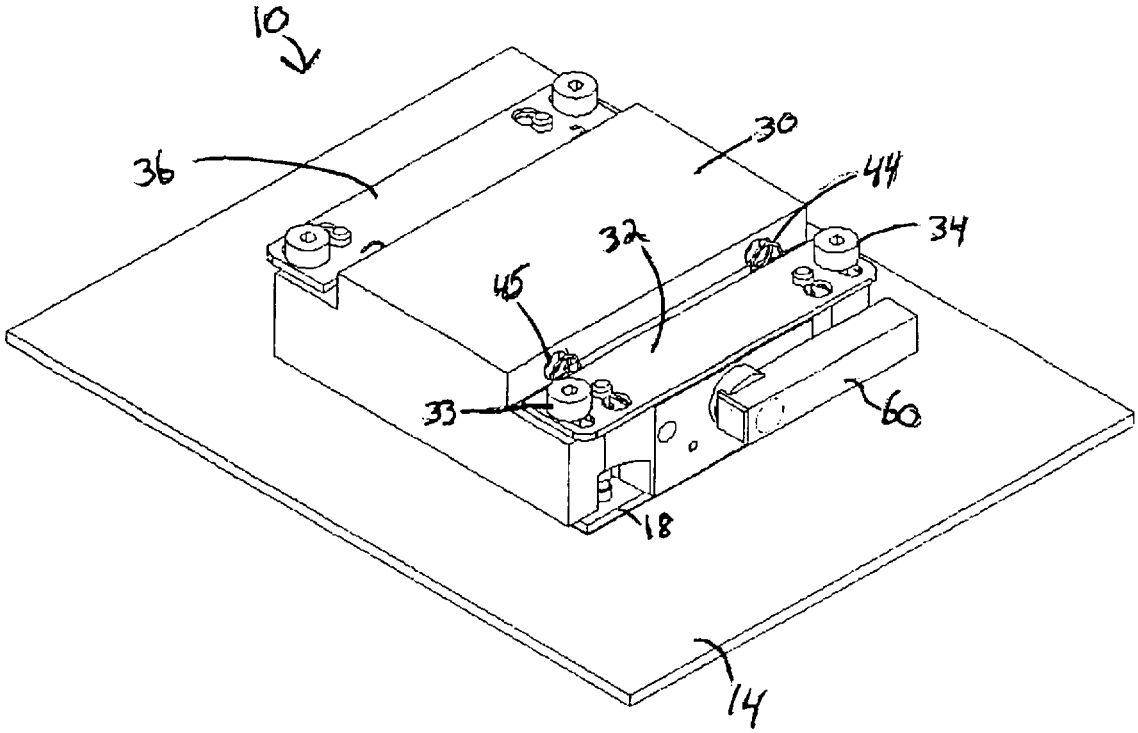

A first embodiment of the invention is shown in FIGS. 1A and 1B. Apparatus 10 according to the invention applies a mechanically-releasable, balanced compressive load to sheet 12 of anisotropic conductive elastomer (ACE) as part of an electrical connector that connects electrical device 16 (for example a computer chip) to substrate 14 (for example a printed circuit board). Alignment socket 18 accomplishes proper mechanical alignment of device 16 to ACE material 12 and board 14 in conjunction with the alignment holes through socket 18 and material 12 and board 14 through which pins 26–29 pass, as explained in more detail below. The connector could alternatively be accomplished with an electrical device having some compliance, for example a device with spring-loaded pins, or with another type of connection having compliance, for example a connector with compliant pins.

Apparatus 10 accomplishes the invention in an embodiment that requires access only to the top side of board 14 to allow device 16 to be changed. This embodiment thus is useful in test and burn-in situations in which device 16 must be switched one or more times during operation, and/or in situations in which there is little physical space below board 14.

Apparatus 10 further includes rigid backup plate 20 that lies against the underside of board 14. This embodiment shows optional cutouts 21 in backup plate 20 that are placed so that the backup plate does not interfere with other objects projecting from the bottom side of board 14. Rocker plate 22 lies against the underside of backup plate 20 and contacts backup plate 20 only at the center of the backup plate, in this example through the round tip of set screw 24 that is received in a threaded insert in the center of rocker plate 22.

In order to accomplish a balanced compressive load, three pins all equidistant from one another can be used. In the preferred embodiment, though, four pins are used. These pins or studs 26–29 are placed symmetrically about the center of rocker plate 22. These pins pass up through backup plate 20, board 14, ACE material 12, alignment frame 18, and through rigid member or rocker body 30 that sits on device 16. Rigid member 30 can be a heat sink with heat-radiating fins, not shown in the drawing. Pins 26–28 are mechanically coupled to member 30 through rocker arm latch plates 32 and 36 that are held in the top of member 30 by shoulder bolts 33, 34 and 37, 38, respectively. Enlarged heads 26*a*–29*a* of pins 26–29, respectively, are received in the more narrow portions of variable-width keyhole slots in latch members 32 and 36 (slot 42 label). The heads are smaller than the enlarged portion at the outside of each of these slots. Thus, the pins can be released from the slots by pushing latch plates 32 and 36 in toward the center of rocker body 30. The shoulder bolts are received in slots such as slot 40. Slots are used so that latch plates 32 and 36 can move laterally to engage and disengage pins 26–29, as described below.

The mechanically-releasable compressive load is accomplished through cam mechanism 50 which comprises cam bearing 52, cam member 56 with cam shaft 57, and operating lever arm 60 that is held to member 56 with screw 62. Shaft 57 is offset from the center of member 56 to provide cam movement of bearing 52 that sits in slot 54 in member 30. Member 56 is received in opening 58 in body 30. As a result, when lever arm 60 is moved between the engaged and disengaged positions (which can be defined by stops or detents, not shown in the drawing) bearing 52 is pushed up against plate 32 or released from plate 32, respectively. Plate 32 is a spring plate. Thus, as the bearing pushes up against the center of plate 32, the center of the plate is flexed upwardly, causing pins 26–29 to be pulled up with equal force, thus causing compressive force to ACE material 12. Since rocker plate 22 can pivot about central point 24 relative to fixed backup plate 22, the compressive load is balanced across backup plate 20 and device 16, thus ensuring an even compressive force about the active area of ACE material 12.

The compressive force is released, and access to device 16 provided, as follows. Lever arm 60 is moved to the release position, to decrease or remove the force on latch plate 32 caused by cam bearing 52. Springs such as springs 44 and 45 that sit against the inner edge of the latch plates allow their lateral movement, but automatically return the latch plates to their engaged position. When the latch plates are pushed inward, the pin heads are disengaged, and the entire rocker body and the attached mechanism can be lifted off of device 16. Device 16 can then be lifted out of alignment socket 18 and replaced with another device for use or test as desired. Body 30 can then be placed back over the heads of the pins, and the latch plates released to lock back onto the heads of the pins. Lever arm 60 can then be rotated to the compression position in which spring force is provided by the spring latch plates 32 and 36.

Figure 2A:
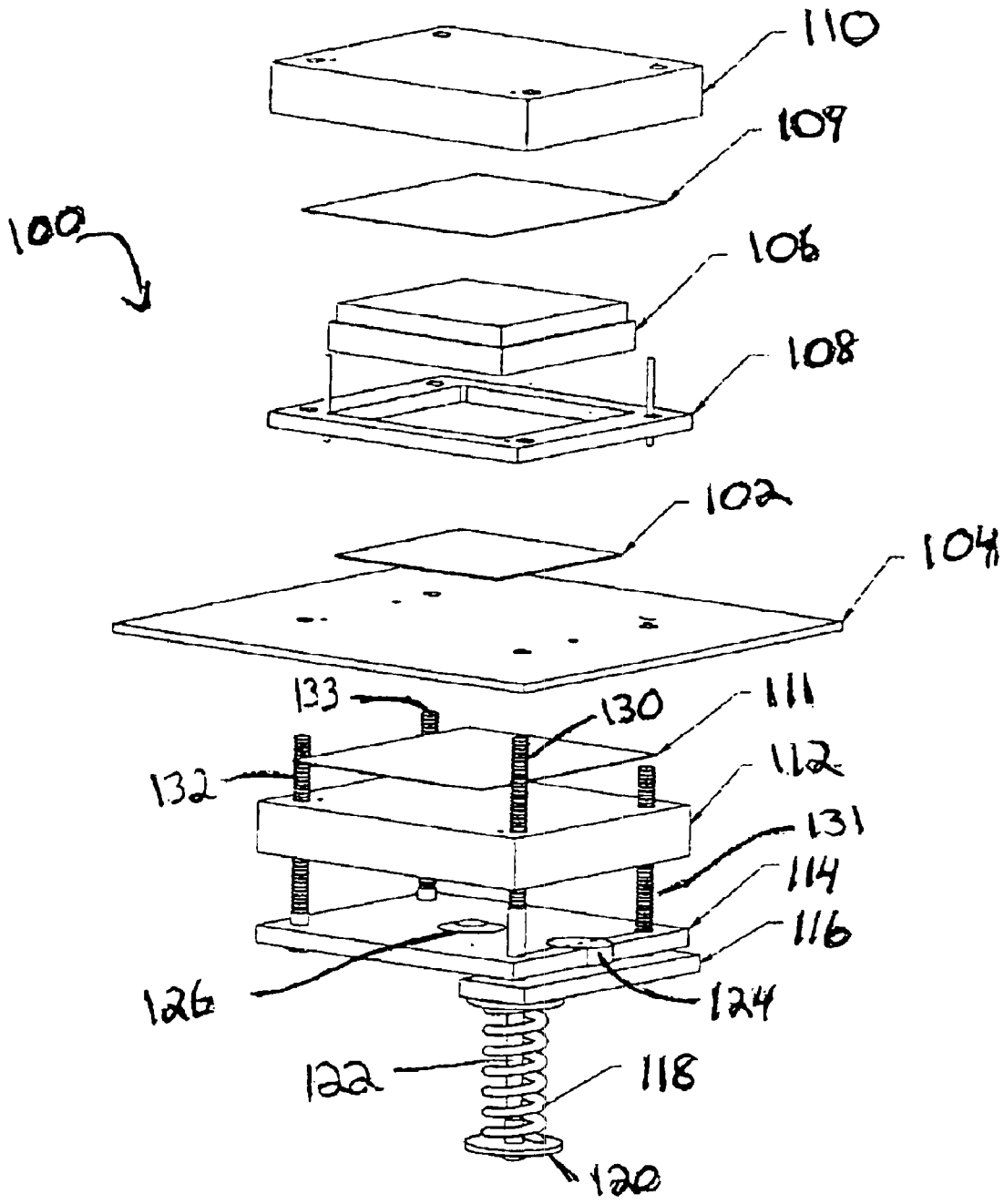
FIG. 2A is an exploded view of a second embodiment of the separable electrical connector system of the invention, showing the spring on the underside of the printed circuit board.

Another embodiment of the invention is shown in FIGS. 2A–2D. FIG. 2A is an exploded view, and FIG. 2B a fully assembled view. Embodiment 100 of the invention includes heat sink 110, optional heat spreader 109 that sit on electrical device 106 that is received in alignment guide or socket 108 that is held on substrate 104 by pins, shown but not further described. ACE material 102 sits between device 106 and board 104. Optional insulator plate 111 can be used to provide electrical insulation between the bottom of board 104 and rigid backup plate 112. Rocker plate 114 includes central contact 126 so that it contacts plate 112 only at its center. Balanced compressive force is provided by a rocker member (arm 116) that can pivot on central pivot point 124 relative to plate 114 in the direction of arrow A, FIG. 2C, together with coil spring 122 and compression element 120. The forces are transmitted from two adjacent pins to the ends of the rocker arm. The pins are shown in locations that are fully symmetrical about the center of the device, to guarantee their kinematic balance. Since the rocker arm can pivot about its central attachment point, it pulls equally on both of the pins it engages. The force from these pins is transmitted by the rocker arm to the rocker plate. The rocker plate engages and pulls against the other two pins, while pushing down against the backup plate through its central pivot and pushing up against the rocker arm at its end pivot. Since its central pivot and its end pivot are both on a line that passes midway between the pins it engages, the rocker plate pulls equally on both of the pins that it engages. Since the distance from the rocker plate's central pivot to the rocker plate's end pivot equals the distance from its central pivot to the center line of the two pins it engages, the total pull on the two pins engaged by the rocker plate must equal the total force on the two pins engaged by the rocker arm. Therefore, the pull on all four pins must be equal. The forces on the system are thus not merely intrinsically centered, but also intrinsically equal. The loading on the backup plate is intrinsically centered even if the pin locations are not symmetrical about the center of the device; pin symmetry merely guarantees identical pin tension.

Additional clarification is provided in FIGS. 2C and 2D, which are edge and bottom views, respectively of this embodiment. The rocker arm pivots on the rocker plate under the tension applied by pins R1 and R2. The rocker arm is only allowed to touch the rocker plate at pivot point 124. The dimensions L1 and L2 are equal. Hence, any tension applied to R1 will be balanced by an equal tension in R2 via the floating rocker arm. The rocker plate is mounted pivotally to the backup plate such that it only contacts the backup plate at its pivot. Furthermore, L5 is set equal to L6, and L4 equals L3. For this system to stay floating on the pivots, it is readily shown that the tension in all four tension members or pins must be equal. Hence, once the connector has been assembled, any increase in tension in any single member will be mirrored in all the other three tension members.

Either or both of the rocker plate and rocker arm can be designed as flexible spring elements. Alternatively, they can be relatively rigid, with the spring element(s) residing elsewhere. Since the forces are intrinsically balanced, the resilient element(s) can be placed in various locations, e.g. Belleville washers in one or all four corners, or a single coil spring in one corner as shown. The spring(s) can alternatively be above the plane of the substrate (pushing up against the top(s) of the pin(s) and down against the heat sink) and/or below the rocker arm as shown in the figures (pushing down against the bottom(s) of the pin(s) and up against the rocker plate and/or rocker arm).

If desired, the rocker arm can be above the substrate, either pulling the heat sink down from below, or pushing the heat sink down from above. This reduces the space required below the board in applications with limited below board space. While two (e.g. symmetrical) rocker arms could be used, the additional degree of freedom provided by this additional articulation is unnecessary, but could be used to increase the flexibility and thus the dynamic range of the system.

Advantages:

These two embodiments of the invention intrinsically equalize the tension on the pins, and allow the system to be preloaded from either side. The system can be preloaded in many ways, including nuts on a threaded end (top or bottom) of any of the pins, or a setscrew as the pivot point of the rocker plate or rocker arm. Another method of preloading the system would be to have a lever, linkage or cam; the kinematics of the system allow this to exist as part of any of these interfaces. A resilient element or elements (e.g. Belleville (spring) washers) can also exist at any or all of these points, independent of where the preload actuation is done.

Being able to replace a device without requiring access to the opposite side of the substrate is at least an advantage and occasionally a requirement for use on the main board of many personal computers.

Alternative Embodiment:

If the pins are sufficiently strong and the heat sink pressing down on the device is sufficiently strong and stiff, a similar result can be obtained using a spring plate that pulls on two diagonally opposite corner pins, and pushes up against the backup plate. (This spring plate could be roughly diamond-shaped, which would increase its compliance relative to its strength, compared to a rectangular plate.) The load can be applied at one point to the center of the backup plate or at multiple points, as long as the loading points from each spring plate exist on a line passing through the center of the backup plate, these points span the center of the backup plate, the line is at a significant angle to a line connecting the diagonally opposite corner pins being pulled on by the spring plate, and that the spring plate can rock about its attachments to the corner pins. This configuration also allows the preload to be applied at a single point and from either side, but places more stringent requirements on the strength of the tooling pins and the rigidity of the heat sink. One or more fins running along the heat sink between the loading points would dramatically increase the effective rigidity of the heat sink for this configuration. An advantage of this system is that the force applied to the backup plate could be applied at multiple points (on a common line previously defined) while the combined resultant would still be intrinsically centered; this would reduce the concentrated point load on and thus the mechanical requirements of the backup plate.

Figure 3:
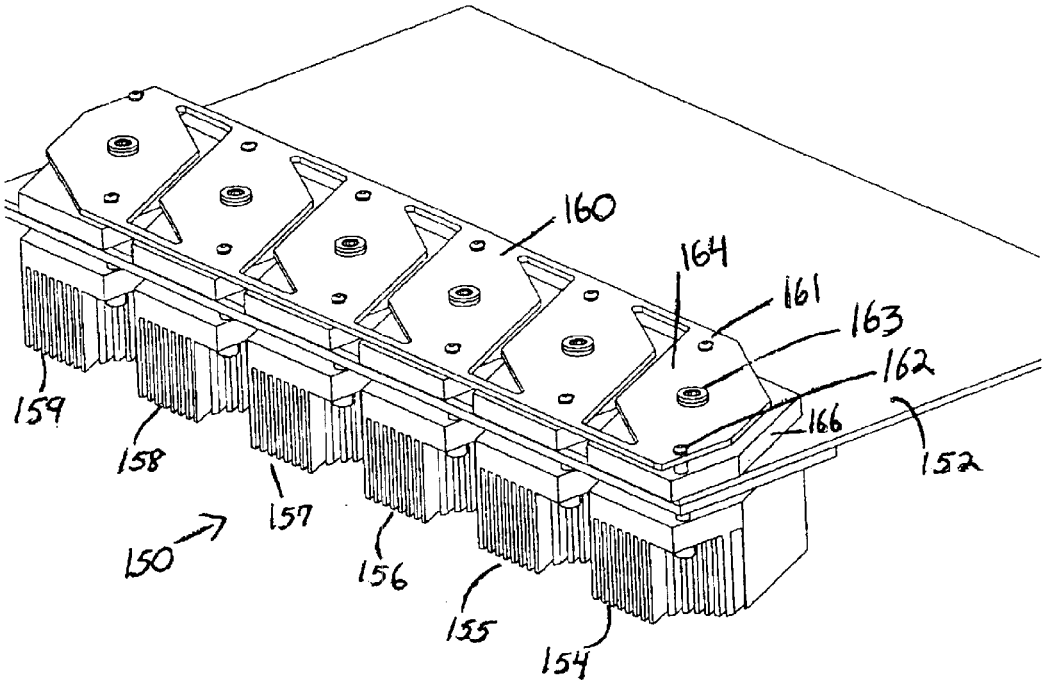
FIG. 3 is a bottom isometric view of another embodiment of the separable electrical connector system of the invention.
Figure 4A:
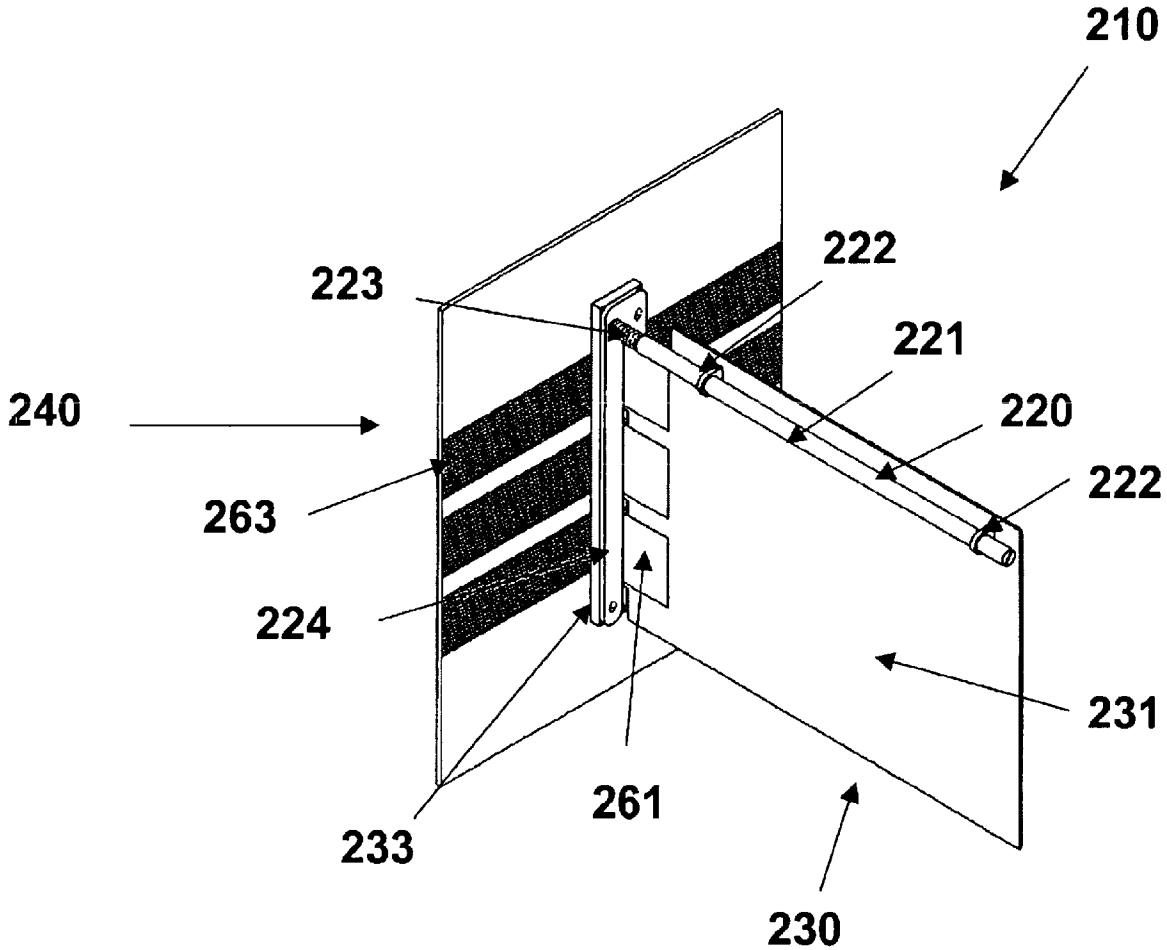
FIG. 4A is a front isometric view and FIG. 4B is a back isometric view of the preferred separable electrical connector system of the invention.
Figure 4B:
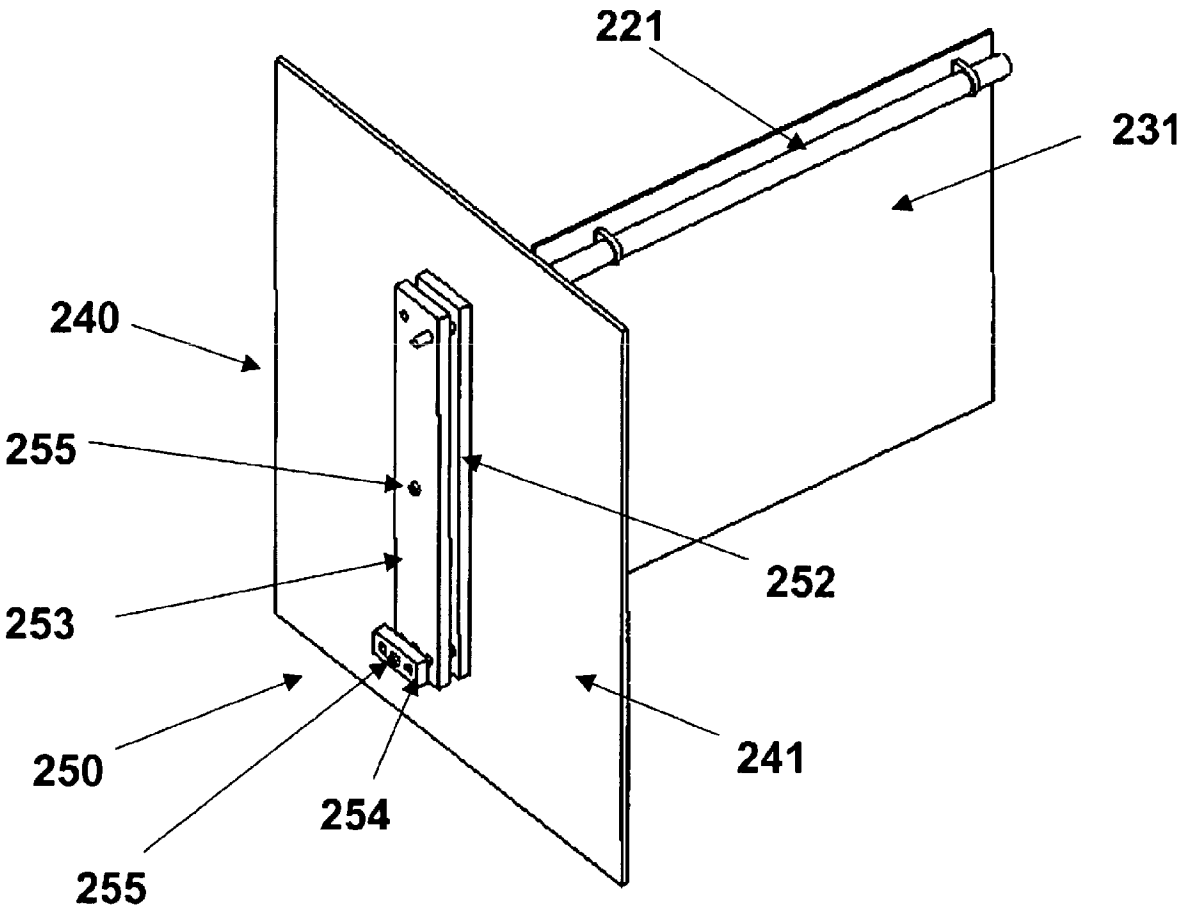
Figure 5A:
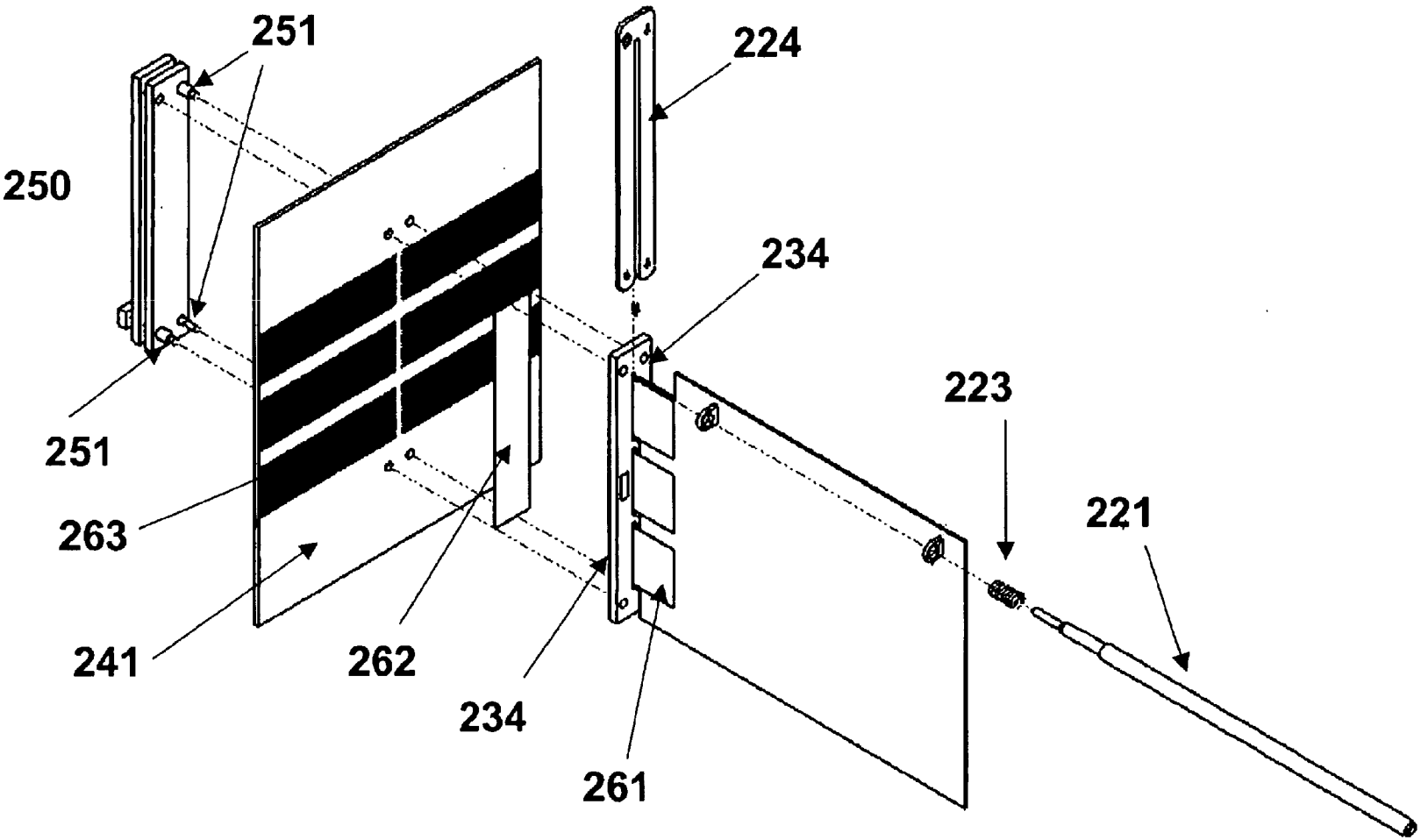
FIG. 5A is front isometric exploded view and FIG. 5B is a rear isometric exploded view of the separable electrical connector system of FIGS. 4A and 4B.
Figure 5B:
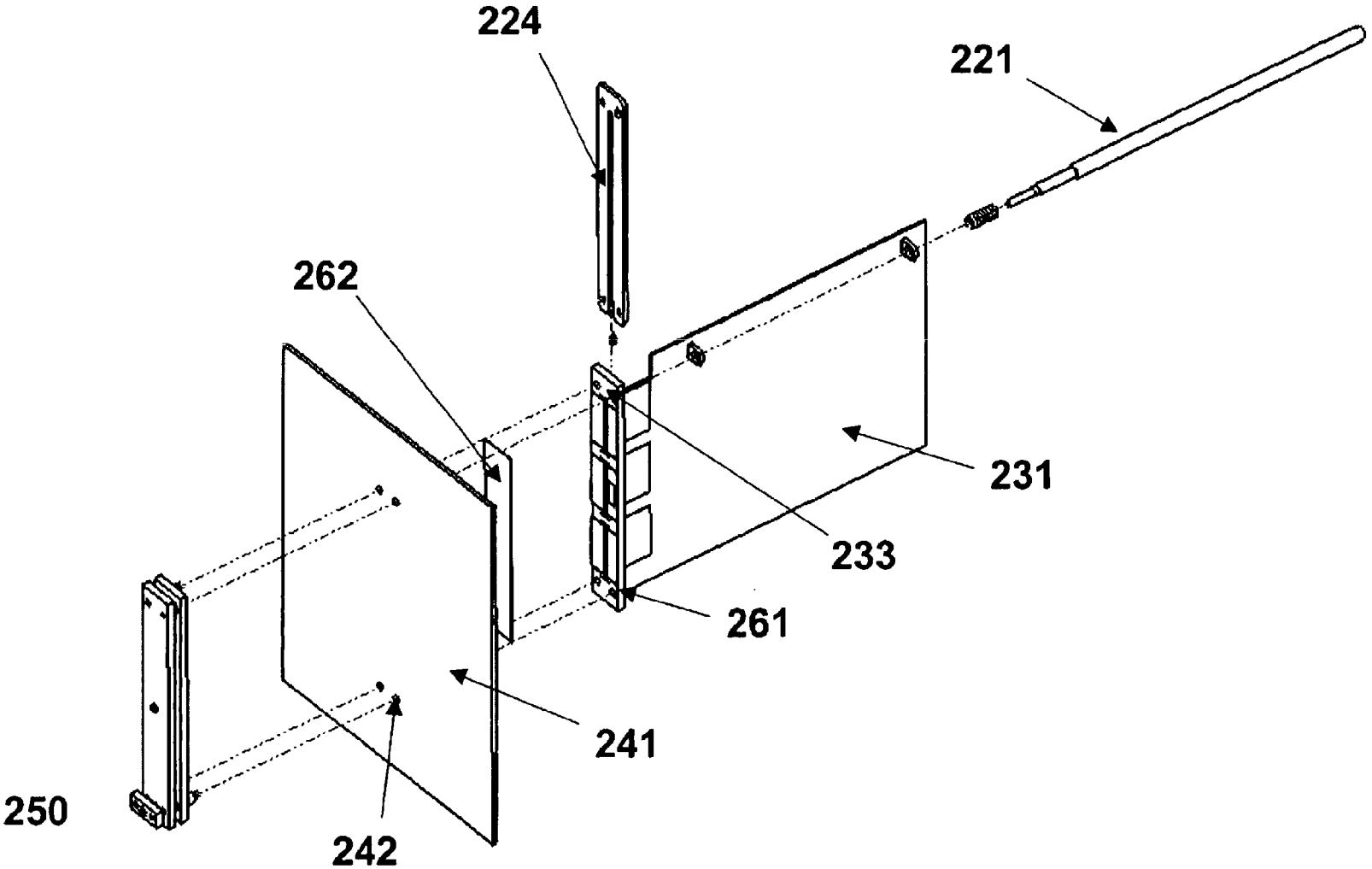
Figure 6:
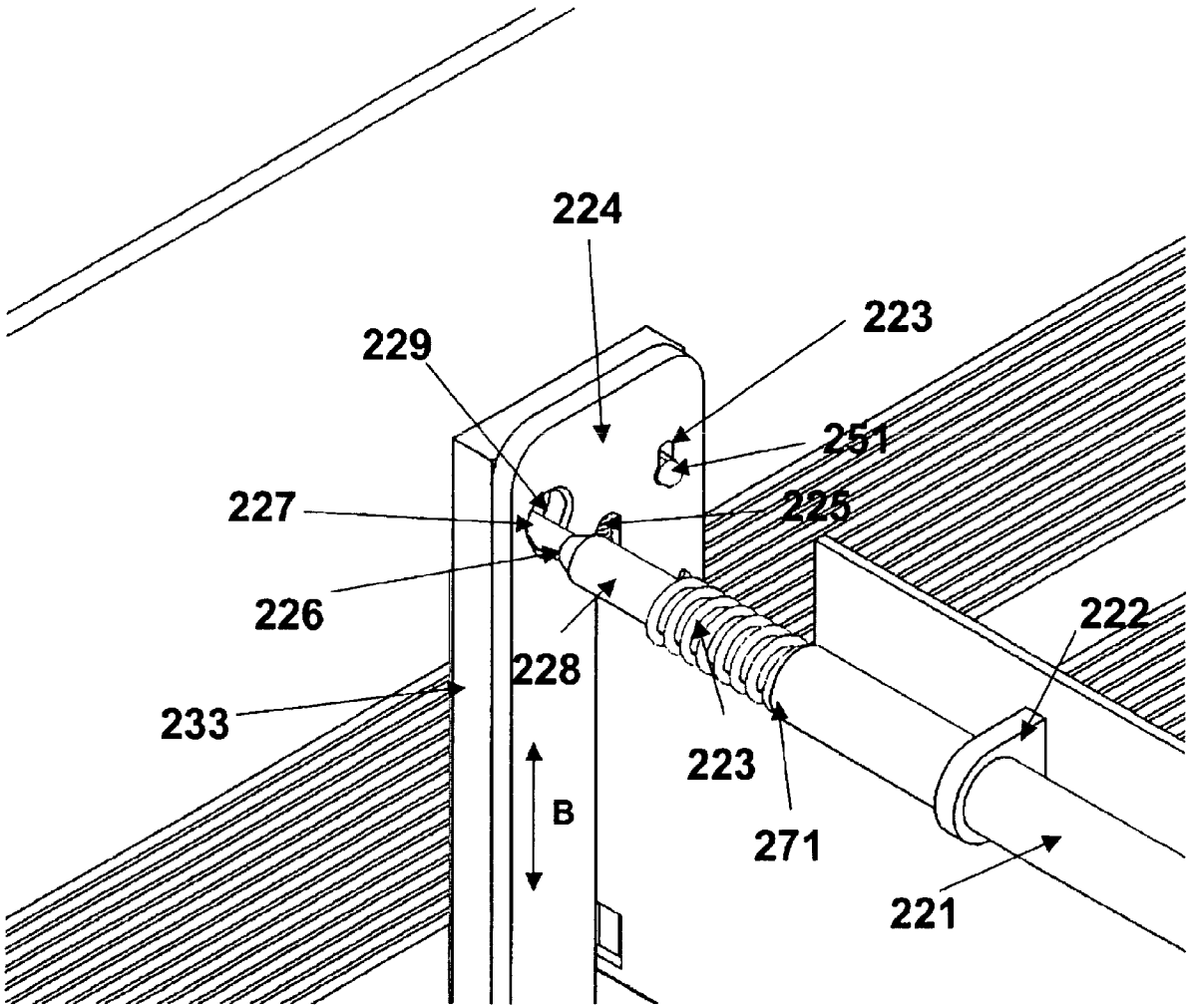
FIG. 6 is a partial enlarged view of the engagement of the front side latch screw of the embodiment shown in FIGS. 4A, 4B, 5A, and 5B.
Figure 7:
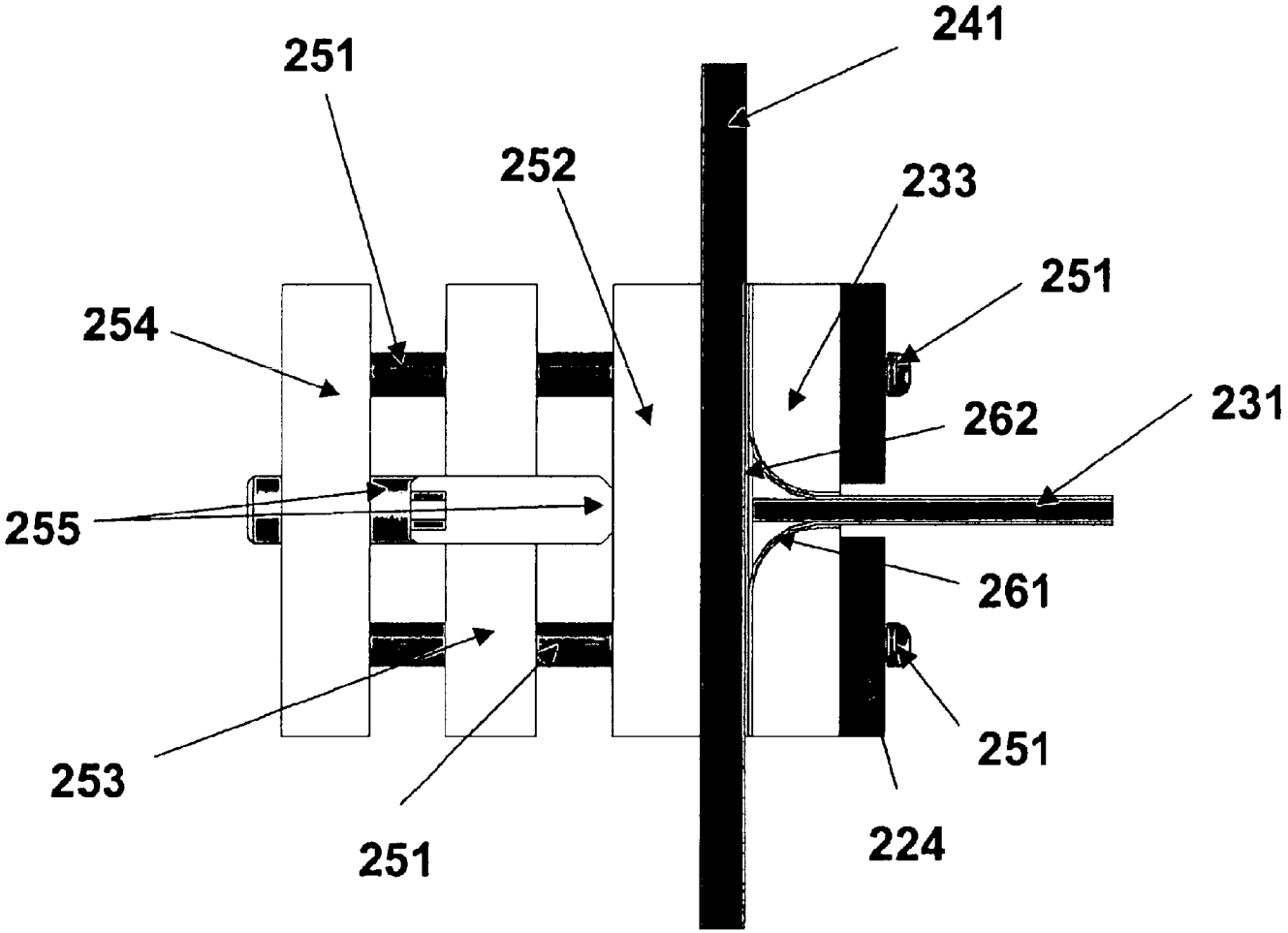
FIG. 7 is a cross-sectional view of the separable electrical connector system shown in FIGS. 4A, 4B, 5A, 5B, and 6.

An example of this is shown in FIG. 3. In this example six devices are mounted to the board using a six diamond spring structure 160 configured from the same sheet. This facilitates both the assembly and reduces cost. The fins of the heat sink 154–159 serve the dual role of both adding strength to the structure and conducting heat. FIG. 3 depicts six diamond spring structures such as one structure 164 that is held by diagonally opposite pins 161 and 162 that are received at their other ends in heat sink 154, which may be a separate heat sink or one-sixth of a six-heat sink assembly 150 that can match the six spring assembly 160. Central point 163 is the point of contact between spring member 164 and backup plate 166 that sits on the bottom of board 152.

A stacked pair of these diamond plates could also be used. The force applied to the backup plate would still be intrinsically centered, even though the two pairs of pins would not necessarily have identical forces. This would bring the tensile forces on each pin back to about ¼ of the total force. The lower diamond plate could push up against the intermediate diamond plate at the center, or along a line running through the axis of the intermediate diamond plate, while the intermediate diamond plate pushed up against the backup plate. Alternatively, the intermediate diamond plate could push up against the backup plate while have clearance(s) allowing the lower diamond plate to push up against the backup plate. This would allow the forces on the backup plate to be distributed along two lines intersecting at its center, further reducing the mechanical requirements on the backup plate.

As described above, the invention accomplishes a balanced compressive load in a mechanical clamping system, that can be used in a variety of situations that would benefit therefrom. Also, the embodiments describe the use of one or more springs or spring members as the means for applying the force. However, the invention also contemplates other means for applying force, such as an elastic or compliant member (for example a rubber member) or an air cylinder, for example.

The preferred embodiment of the invention is shown in FIGS. 4A, 4B, 5A, 5B, 6 and 7. Apparatus 210 applies a mechanically-releasable balanced compressive load to a compliant electrical connector that electrically connects an electrical device to a first side of a two-sided substrate. Apparatus 210 comprises backup or stiffener plate 252 that is coupled to the second (typically rear) side of back plane 241. This embodiment depicts a separable orthogonal connection between circuit pack or daughter board 231 and back plane 241. In general, in this embodiment of the invention one of the four load pins comprises latch screw 221 that is accessible from the front side of the assembly. Latch screw 221 has a threaded portion at its proximal end that is selectively receivable in the rocker plate. The other three pins are selectively coupled to a rigid member on the front side of the back plane. The ACE material is located between circuit pack 231 and back plane 241 for providing separable compliant electrical connection between circuit pack 231 and back plane 241.

Figure 2B:
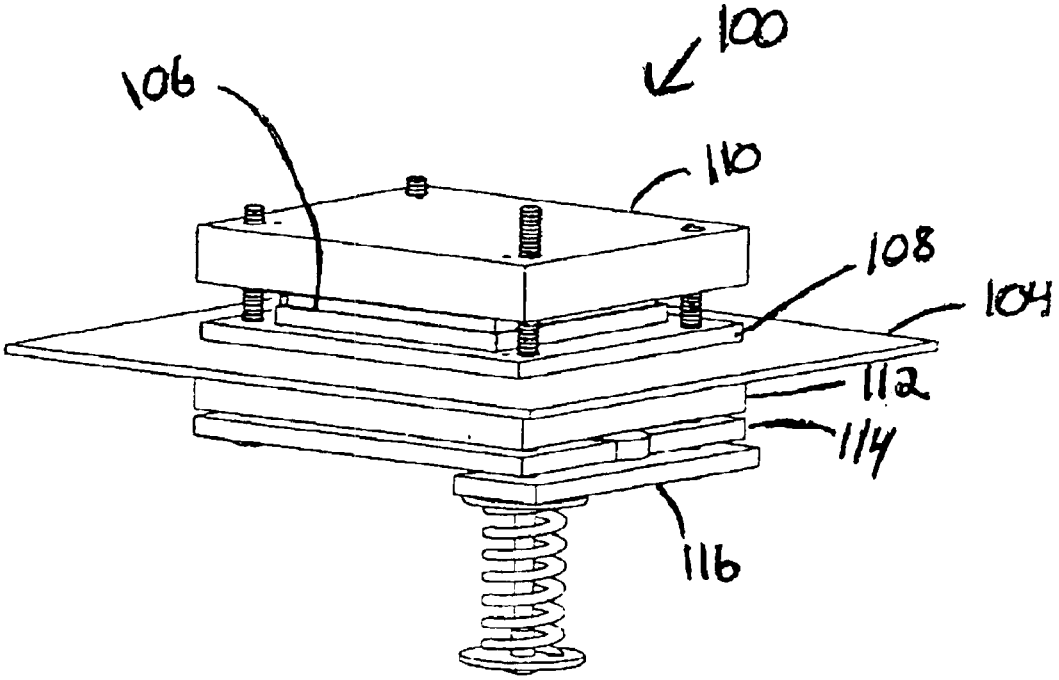
FIG. 2B is an isometric view of the apparatus of FIG. 2A.

Three load pins 251 are carried by the assembly on the back side of the back plane, in a similar manner to the embodiment shown in FIGS. 2A and 2B. In this case, however, the fourth pin is selectively receivable in rocker assembly 250 operable from the front side of the back plane. Also as with the embodiment shown in FIG. 2A and 2B there is a rocker member or arm 254 to which two of the alignment/load pins 251 are coupled. Rocker arm 254 pivots on rocker plate 253 on a single pivot point. Similarly, rocker plate 253 pivots on stiffener plate 252 about a single central pivot point. This arrangement ensures a uniform, balanced compressive load about all four of the pins with a single compressible load spring 223, FIG. 6, applying the force.

The spring is coupled to the assembly as follows. See the figures, particularly FIG. 6, for the details. Alignment plate 233 and latch plate 224 have a central opening through which circuit pack 231 extends. Circuit pack 231 is fastened to plate 233 by mechanical device (not shown). Alignment plate 233 provides a compressive force to ACE layer 262. In the embodiment depicted in these drawings, there is an intervening flexible circuit layer 261, however this is not necessary to the functionality of this embodiment of the invention. Latch plate 224 is slidable up and down relative to alignment plate 233 in the direction of arrow B, FIG. 6. The three pins 251 have a slot or neck aligned with latch plate 224. Keyhole-shaped openings 234 engage with the ends of pins 251. Latch spring 225 biases plate 224 to a position (before latch screw 221 is engaged) in which the enlarged ends of openings 234 are aligned with the ends of pins 251. This allows plates 233 and 224 to be slipped over the protruding ends of three pins 251. Narrow proximal end 227 of pin 221 is then pushed into opening 229 in plate 224 (and a corresponding opening, not shown, in plate 233), through an opening in the back plane, and engaged in rocker plate 253. Latch screw brackets 222 hold latch screw 221 to circuit pack 231. As latch screw 221 is further screwed into rocker plate 253, tapered shoulder 226 engages the bottom of slot 228 and thereby pushes latch plate 224 down, which compresses latch spring 225 and moves the narrow end of openings 234 behind the larger ends of pins 251. This action couples pins 251 to plate 224, and thus to the front side of back plane 241.

Compressible coil spring 223 is received on intermediate portion 228 of latch screw 221 and is compressed against shoulder 229 to provide the compressive force that is coupled through latch screw 221 and alignment/load pins 251 to press both the alignment plate 233 and stiffener plate 252 toward back plane 241. This provides the compressive force necessary for ACE layer 262 without bowing the back plane. The circuit pack can be removed from the board by simply unscrewing latch screw 221, which both releases the compressive force and releases latch plate 224 from pins 251, thus allowing circuit pack assembly 230 to be lifted off of back plane 241.

As mentioned briefly above, this embodiment can also include one or more flexible circuit elements that couple electrical members on the sides of circuit pack 231 to one or more circuit elements 263 on back plane 241. Circuit elements 263 are shown as a number of parallel bus elements, but such is illustrative rather than limiting. Connection could alternatively be made through connectors at the end of circuit pack 231 (such as finger-type connectors) that would be received in a female connector element on back plane 241, for example. Flexible circuit 261 can be bonded to circuit pack 231 using the well-known bonded flex manufacturing process. Electrical traces are then extended from circuit pack 231 into flexible circuit 261 to back plane 241. Flexible circuit 261 passes through the slots in latch plate 224 and alignment plate 233 to the upper side of ACE material 262. The flex circuit is electrically connected to the ACE material by the compressive force generated by load spring 223. The alignment plate 233 can be constructed to guide flex circuit 261 into a smooth bend and can have mechanical features (not shown) to hold the flex circuit in proper alignment.

Figure 8A:
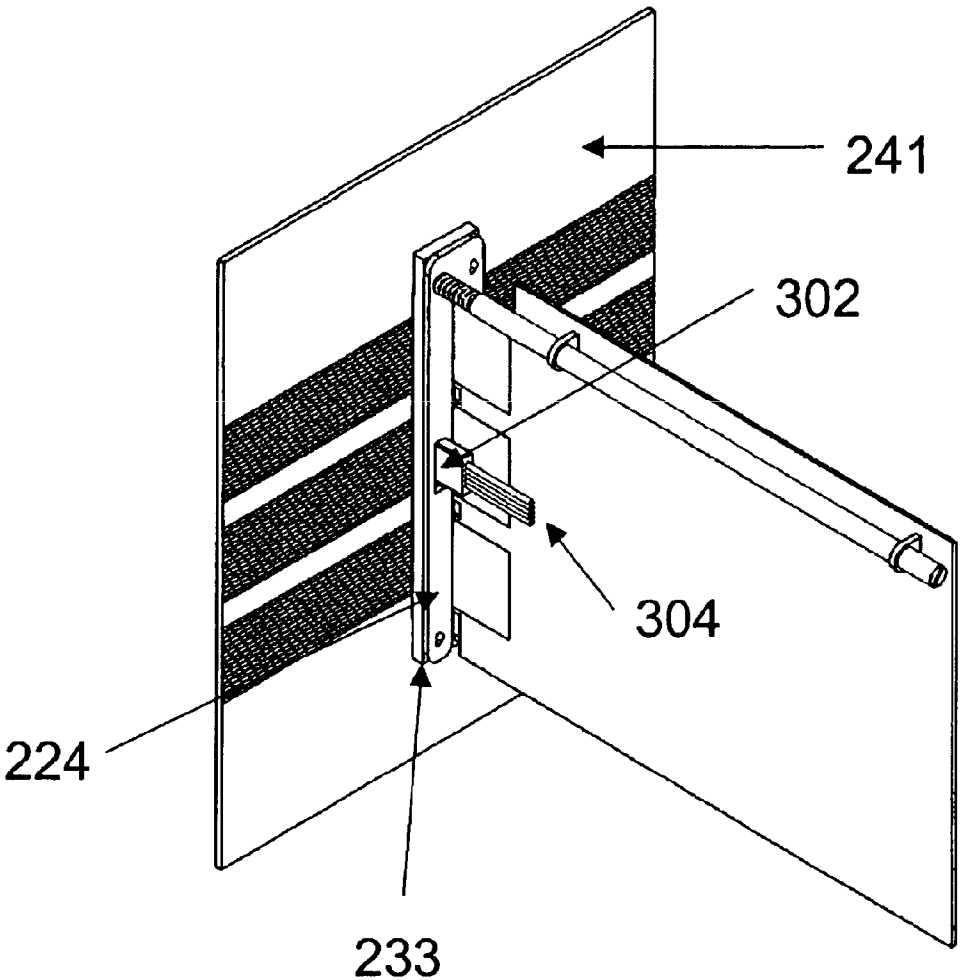
FIG. 8A and 8B are front and cross-sectional schematic diagrams showing sequential coupling of contacts for another embodiment of the invention.
Figure 8B:
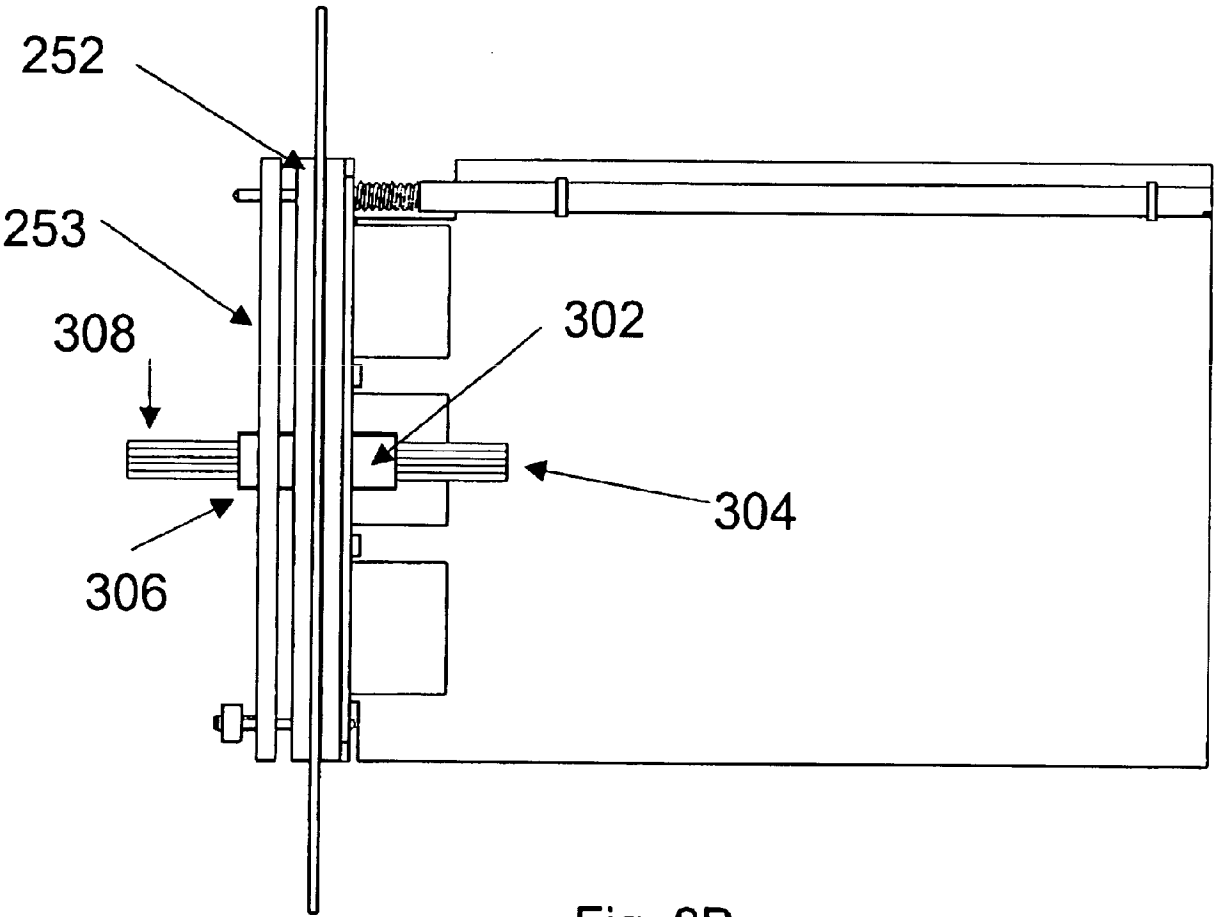

Different contacts can be coupled in a desired sequence by providing one or more spring-loaded contact modules coupled to circuit pack 231 that are sequentially coupled to back plane 241 in a desired sequence. This can be accomplished by including one or more appropriate shaped and sized openings in the alignment plate and latch plate. An example is schematically depicted in FIGS. 8A and 8B, which show an example of a through the back plane fiber optic connection made using the apparatus of the invention. Fiber optic connector 302, which terminates fiber optic cable 304, sits in an opening in latch plate 224 and alignment plate 233. Fiber optic connector 306, which terminates fiber optic cable 308, sits in an opening in rocker plate 253 and stiffener plate 252. The use of such separate connectors, and the arrangement of these connectors relative to the inventive apparatus, allows the fiber optic connection to be made separately from the electrical connection. This separate connection can be arranged to occur just before or just after the electrical connection, or at the same time as the electrical connection, to achieve a desired connection objective. As one example, it might be desirable electrically to make a power connection before or after a data connection. These modules could house such connectors for transferring power, fiber optic connectors, other conventional electrical contacts, or other ACE-based contacts.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An apparatus for applying a mechanically-releasable balanced compressive load to an assembly having at least first and second sides, comprising:

a backup plate coupled to the second side of the assembly;

a rocker plate behind the backup plate, the rocker plate touching the backup plate at only one location;

a rigid member coupled to the first side of the assembly;

at least three pins mechanically coupled to the rocker plate and the rigid member; and a mechanical device, coupled to at least one pin, for applying a force, coupled through the at least one pin, to urge the backup plate and rigid member together and thereby compress the assembly.

2. The apparatus of claim 1, further comprising means for selectively applying the force.

3. The apparatus of claim 1 wherein the spring member comprises a coil spring on a pin.

4. The apparatus of claim 1 wherein at least one pin is operable from the front side of the substrate.

5. The apparatus of claim 1, wherein the rocker member pivot point is equally spaced from the two pins to which the rocker member is coupled.

6. The apparatus of claim 5, wherein the means for applying a force comprises a spring member coupled to a pin and to the rocker plate.

7. The apparatus of claim 1 wherein a member adjustable in length relative to the rocker plate couples the rocker plate to the backup plate.

8. The apparatus of claim 7 wherein the member adjustable in length comprises a set screw threaded in the rocker plate, so that the length of the set screw between the rocker plate and the backup plate can be varied.

9. The apparatus of claim 1 comprising four pins.

10. The apparatus of claim 9, further comprising a rocker member mechanically coupled to two pins and in contact with the rocker plate at a single location.

11. The apparatus of claim 9 wherein the backup plate has a center and the pins are spaced equally from the center of the backup plate.

12. The apparatus of claim 1 further comprising means for releasably engaging each pin with the rigid member.

13. The apparatus of claim 12 wherein the means for releasably engaging comprises one or more slots in the rigid member, each slot accepting a pin, the slots having a wider portion and a more narrow portion, to selectively engage and disengage a pin.

14. The apparatus of claim 13 wherein the pins that are accepted in the slots include an end that is smaller than the wider portion of the slot and larger than the more narrow portion of the slot, so that the pin can be releasably retained in the slot.

15. The apparatus of claim 14 wherein the rigid member comprises a fixed portion and a movable portion to engage and disengage one or more of the pins, to allow the rigid member to be removed from the device.

16. The apparatus of claim 15 wherein the movable portion comprises a plate movable relative to the fixed portion.

17. The apparatus of claim 16 further comprising a spring between the movable plate and the fixed portion to urge the movable portion to a position in which it is disengaged from one or more of the pins.

18. The apparatus of claim 1 wherein the mechanical device for applying a force comprises at least one spring member.

19. The apparatus of claim 18, wherein the spring member is selectively coupled to a pin and to the rigid member.

20. The apparatus of claim 18, further comprising means for controlling the amount of applied force.

21. The apparatus of claim 20 wherein the means for controlling the amount of applied force comprises mechanically varying the spring member compression.

22. The apparatus of claim 1 wherein the assembly comprises a compliant electrical connector that electrically connects an electrical device to a first side of a two-sided substrate.

23. The apparatus of claim 22 wherein the electrical connector comprises compressible anisotropic conductive elastomer (ACE).

24. The apparatus of claim 22 wherein at least one pin is operable from the front side of the substrate, and is coupled to the electrical device.

25. The apparatus of claim 24 wherein the at least one pin operable from the front side of the substrate defines a threaded end that is selectively receivable in the rocker plate.

26. The apparatus of claim 25 wherein the at least one pin operable from the front side of the substrate carries a spring member that is compressible to apply the force.

27. The apparatus of claim 22, further comprising a flexible circuit in the electrical path between the device and the substrate.

28. The apparatus of claim 27 wherein the compliant electrical connector comprises ACE material between the flexible circuit and the substrate.

29. The apparatus of claim 22, further comprising one or more contact modules movably coupled to the rigid member that sequentially make contact with the substrate, to accomplish sequential contact with the substrate.

30. An apparatus for applying a mechanically-releasable balanced compressive load to a compliant anisotropic conductive elastomer (ACE) electrical connector that electrically connects a circuit pack orthogonally to a first side of a two-sided substrate, comprising:

a backup plate coupled to the second side of the substrate;

a rocker plate behind the backup plate, the rocker plate touching the backup plate at only one location;

a rigid member coupled to the front side of the substrate;

a layer of ACE between the circuit pack and the substrate;

at least four pins mechanically coupled to the rocker plate and the rigid member;

a rocker arm mechanically coupled to two pins and in contact with the rocker plate at a single pivot; and at least one spring member mechanically coupled to at least one pin, for applying a variable force coupled through the at least one pin, to urge the backup plate and rigid member together and thereby compress the ACE between the electrical device and the substrate; and means for releasably engaging each pin with the rigid member;

wherein one pin is operable from the first side of the substrate and defines a threaded end selectively receivable in the rocker plate for selectively applying the spring force to compress the layer of ACE.

31. An apparatus for applying a mechanically-releasable balanced compressive load to a compliant electrical connector that electrically connects an electrical device to a first side of a two-sided substrate, comprising:

a backup plate coupled to the second side of the substrate;

a rocker plate behind the backup plate, the rocker plate touching the backup plate at only one location;

a rigid member coupled to the first side of the substrate;

at least four pins mechanically coupled to the rocker plate and the rigid member;

a rocker arm mechanically coupled to two pins and in contact with the rocker plate at a single pivot; and a mechanical device, coupled to at least one pin, for applying a force, coupled through the at least one pin, to urge the backup plate and rigid member together and thereby compress the compliant electrical connector between the electrical device and the substrate.

* * * * *